United States Patent [19]

Virginio

[11] Patent Number: 4,953,703

[45] Date of Patent: Sep. 4, 1990

[54] ANTIBACTERIAL PROTECTIVE ELEMENT FOR MICROPHONES AND TELEPHONE RECEIVERS, AND PACKAGE CONTAINING SAID ELEMENT

[76] Inventor: Lerza Virginio, Via Vespucci 75, 10129 Turin, Italy

[21] Appl. No.: 353,721

[22] Filed: May 18, 1989

[30] Foreign Application Priority Data

Jun. 1, 1988 [IT] Italy ..... 67506 A/88

[51] Int. Cl.[5] ..... B65B 75/00

[52] U.S. Cl. ..... 206/451; 206/527; 379/452

[58] Field of Search ..... 206/451, 527, 233, 495, 206/447, 449; 379/452

[56] References Cited

U.S. PATENT DOCUMENTS

| | | | |
|---|---|---|---|
| 756,543 | 4/1904 | Thompson | 379/452 |
| 777,583 | 12/1904 | Baethig | 379/452 |
| 965,257 | 7/1910 | Waldron et al. | 379/452 |
| 1,419,212 | 6/1922 | Brewer et al. | 206/451 |
| 1,543,283 | 6/1925 | Falor et al. | 206/451 |
| 2,650,269 | 8/1953 | Webb | 206/451 |
| 3,033,359 | 5/1962 | Mercer | 206/233 |
| 3,225,912 | 12/1965 | Bryant | 206/449 |
| 3,241,588 | 3/1966 | Osher et al. | 206/451 |
| 3,341,003 | 9/1967 | Marsh | 206/451 |
| 3,962,555 | 6/1976 | Efaw | 379/452 |
| 4,546,217 | 10/1985 | Frehn | 379/452 |
| 4,570,038 | 2/1986 | Tinelli | 379/452 |

*Primary Examiner*—David T. Fidei
*Assistant Examiner*—Jacob K. Ackun, Jr.
*Attorney, Agent, or Firm*—Helfgott & Karas

[57] ABSTRACT

An antibacterial protective element for microphones and telephone receivers, comprising a flexible polyethylene film adhered to the aforementioned devices to form a diaphragm impenetrable to the microbes issued during the telephone conversation. A package containing the protective element comprises a cover, a series of the protective element and separating sheets arranged therebetween, both the protective elements and the separating sheets being inserted in the cover and being retained along one side thereof by a plurality of staples or pins with depressable legs or by a thermoadhesive strip. The element is particularly useful for avoiding infection during telephone calls from public telephone booths.

5 Claims, 1 Drawing Sheet

ANTIBACTERIAL PROTECTIVE ELEMENT FOR MICROPHONES AND TELEPHONE RECEIVERS, AND PACKAGE CONTAINING SAID ELEMENT

BACKGROUND OF THE INVENTION

This invention relates to an antibacterial protective element for microphones and telephone receivers and to a package containing such a protective element.

It is known that telephones for public use may sometimes cause transmission and diffusion of infective diseases. In fact, when a person affected by an infective disease uses a telephone, he may deposit during the conversation a considerable amount of microbes on the telephone receiver generally and in particular on the microphone of the telephone and on the cavity containing the microphone.

For this purpose it is known to use spray bottles containing a disinfectant liquid which is sprayed in the form of an aerosol on the telephone receiver for disinfecting it. Although this system is relatively efficient with regard to killing the pathogenous microbes, it has the drawback of introducing the sprayed disinfectant into the microphone box and damaging the latter when it is repeatedly used.

Also devices are known that are made of elasticized fabric of particularly close mesh, which are applied to the receiver, fitting the shape thereof. This type of protection, too, has two drawbacks, i.e. that of considerably distorting the tone of the voice of the person speaking on the telephone and that of retaining the microbes transferred to the interior of the fabric.

It is therefore an object of the present invention to provide an antibacterial protective element for microphones and telephone receivers, which permits to eliminate or reduce the drawbacks of the aforementioned known protective devices and which is such as to ensure a safe and efficient protection of the person using the telephone from potential contamination by infective diseases.

A further object of the invention is to provide a package which permits the antibacterial protective element to be easily applied to the microphone or the receiver and also permits the protective element to be conveniently extracted and separated from the package.

SUMMARY OF THE INVENTION

These and other objects and advantages of the invention, which will become apparent from the following description, are achieved according to the invention by providing an antibacterial protective element for microphones and telephone receivers, which is characterized by the improvement that the protective element is formed by a flexible polyethylene film of a size substantially corresponding to that of the microphone or telephone receiver.

Another object of the present invention consists in providing a package for the antibacterial protective element, which package comprises a plurality of such protective elements interposed between separating sheets, both the protective elements and separating sheets being secured along one side thereof within a cover formed of two leaves one of which has flexible closure means.

DESCRIPTION OF PREFERRED EMBODIMENT

Figure 1:
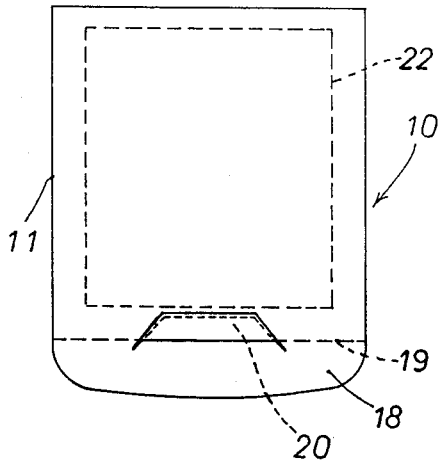
FIG. 1 is a plan view of a package according to the invention in the closed position.
Figure 2:
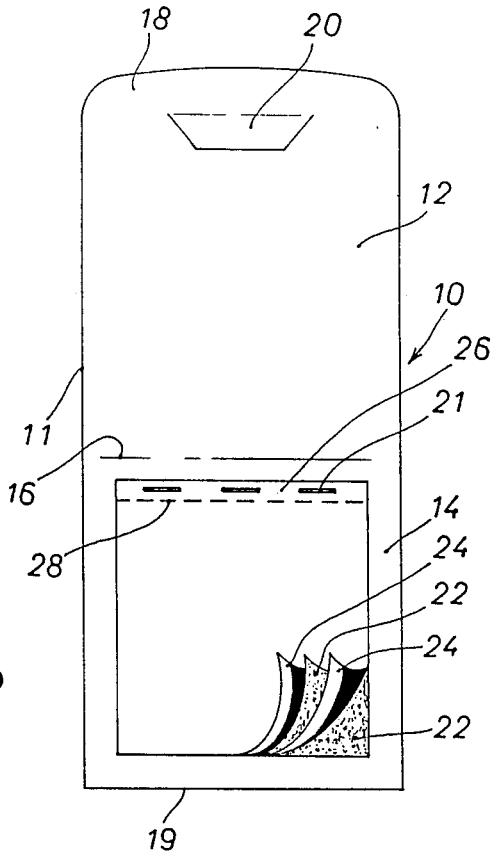
FIG. 2 is a plan view of the package of FIG. 1 in the open position, showing protective elements and separating sheets.
Figure 3:
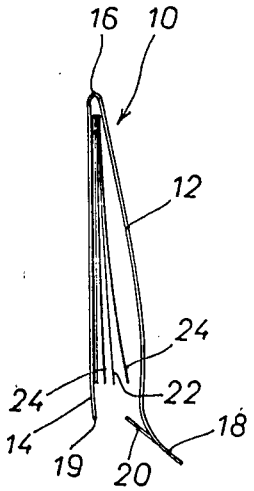
FIG. 3 is a side view of the package of FIG. 1, showing the cover in the open position.

Referring to FIGS. 1, 2 and 3, indicated generally by 10 is a package having a generally rectangular shape and comprising a cover 11 formed of a pair of flat leaves 12 and 14 which can be folded together along a horizontal line 16.

The leaf 12 is of greater length than that of the leaf 14 to form an exceeding portion 18 in which a flexible tab 20 is made which, when the leaves are folded together, extends beyond an edge 19 of the leaf 14 and snugly adheres to the latter to form a perfect closure for the package 10.

The package 10 can be opened by exerting on the exceeding portion 18 a slight outward pressure to cause the flexible tab 20 to release the leaf 14 on which it is supported, so that the user can easily take out protective elements indicated by the numeral 22 in the drawings and arranged in the interior of the cover 11.

As described previously, a plurality of protective elements is arranged in the cover 11 and each of these elements is made of a polyethylene film 22 of a size slightly smaller than that of the cover 11. Interposed between each protective element 22 and the adjacent one is a separating sheet 24 of paper to prevent the polyethylene protective elements 22 from adhering together.

Figure 4:
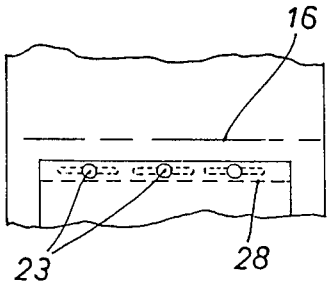
FIG. 4 is a part plan view of one form of locking means for the protective elements of the package of FIG. 1.
Figure 5:
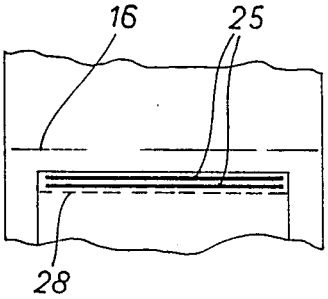
FIG. 5 is a part plan view of another form of locking means for the protective elements.

Both the protective elements 22 and the separating sheets 24 of paper are joined together along one side 26 and the latter is in turn joined to the cover 11 by appropriate means such as, for example, staples 21, shown in FIG. 2, pins 23 with depressable legs, shown in FIG. 4, or thermoadhesive strips 25, shown in FIG. 5.

As shown in FIG. 2, perforated lines 28 are cut into the protective element 22 to permit and facilitate it to be torn off when it is to be used.

The protective element according to the invention is easy to use as appears from the following description. It is sufficient to spread the protective element 22 over the microphone or telephone receiver and due to its inherent constituent characteristics the protective element will strongly and stably adhere to the microphone or telephone receiver without impairing or lowering the tone and level of the voice of the user.

At the end of the conversation it is sufficient to remove the polyethylene element 22 from the microphone and telephone receiver.

The advantages obtained by the protective element according to the invention essentially consist in that the microbes issued during the conversation are not deposited on the microphone or telephone receiver and the microbes that may have been deposited during previous conversations cannot rise from the microphone or telephone receiver to the user.

Although a preferred embodiment of the invention has thus been described in detail and with reference to the accompanying drawings, it is to be understood that the invention is not limited to this precise embodiment and that numerous changes and modifications obvious to one skilled in the art may be made therein without thereby departing from the scope of the invention as defined by the appended claims. For example, the form of the package may differ considerably from the general form illustrated to meet requirements of agreeable appearance, convenience or handling. Also the closure system may differ from the one illustrated; for example, instead of a closure tab a snap fastener may be used.

I claim:

1. A package of antibacterial protective elements for microphones and telephone receivers, comprising a plurality of antibacterial protective elements each of which is formed of a flexible non-perforated self-adhering thermoplastic film of a size substantially corresponding to that of the microphones and telephone receivers, and a plurality of anti-adhesive separating sheets interposed between said antibacterial protective elements to form a stack therewith and prevent them from adhering to each other; a foldable cover enclosing said stack; and retaining means, said antibacterial protective elements and said separating sheets being all secured along one side thereof by said retaining means to said cover inside thereof, said cover being formed of a pair of leaves, one of said leaves being provided with flexible closure means.

2. The package as claimed in claim 1, wherein said retaining means comprises staples.

3. The package as claimed in claim 1, wherein said retaining means comprises pins with depressable legs.

4. The package as claimed in claim 1, wherein said retaining means comprises thermoadhesive strips.

5. The package as claimed in claim 1, wherein said flexible closure means comprises a flexible tab integral with one of said leaves of said cover, said flexible tab in a folded position of said cover superposing another of said leaves of said cover to maintain said package in a closed position.

* * * * *